US010016761B2

(12) United States Patent
Nurmi

(10) Patent No.: US 10,016,761 B2
(45) Date of Patent: Jul. 10, 2018

(54) CRUSHER

(71) Applicant: BMH TECHNOLOGY OY, Rauma (FI)

(72) Inventor: Jarkko Nurmi, Rauma (FI)

(73) Assignee: BMH TECHNOLOGY OY, Rauma (FI)

( * ) Notice: Subject to any disclaimer, the term of this patent is extended or adjusted under 35 U.S.C. 154(b) by 371 days.

(21) Appl. No.: 14/888,034

(22) PCT Filed: May 21, 2014

(86) PCT No.: PCT/FI2014/050387
§ 371 (c)(1),
(2) Date: Oct. 29, 2015

(87) PCT Pub. No.: WO2014/188069
PCT Pub. Date: Nov. 27, 2014

(65) Prior Publication Data

US 2016/0074867 A1 Mar. 17, 2016

(30) Foreign Application Priority Data

May 22, 2013 (FI) ..... 20134123 U

(51) Int. Cl.
*B02C 13/00* (2006.01)
*B02C 13/31* (2006.01)
(Continued)

(52) U.S. Cl.
CPC ..... *B02C 13/31* (2013.01); *B02C 4/02* (2013.01); *B02C 4/08* (2013.01); *B02C 4/10* (2013.01);
(Continued)

(58) Field of Classification Search
CPC ..... B02C 13/31; B02C 13/06; B02C 13/20; B02C 18/06
(Continued)

(56) References Cited

U.S. PATENT DOCUMENTS 1,472,609 A * 10/1923 Martin ..... B02C 13/20 241/154
2,149,571 A 3/1939 Battey
(Continued)

FOREIGN PATENT DOCUMENTS

CN 201711183 U 1/2011
CN 102179274 A 9/2011
(Continued)

OTHER PUBLICATIONS

EP Office Action dated Apr. 12, 2017 for EP Application No. 14801533.2.
(Continued)

*Primary Examiner* — Faye Francis
(74) *Attorney, Agent, or Firm* — Ladas & Parry LLP

(57) ABSTRACT

A crusher having (a) a crusher frame, (b) a crusher rotor with teeth supported on the crusher frame, (c) counter-blade structures within the crusher frame; and (c) upper and lower hatches. The crusher rotor and the counter-blade structures are configured within the crusher so that material fed into the crusher frame can be crushed between the crusher teeth and the counter-blade structures. The upper and lower hatches are hinged to the crusher so that the hatches can be separated to provide an opening through which foreign material may be removed from the crusher while preventing material feeding into the crusher rotor from flowing out of the crusher.

14 Claims, 2 Drawing Sheets

Figure 1:
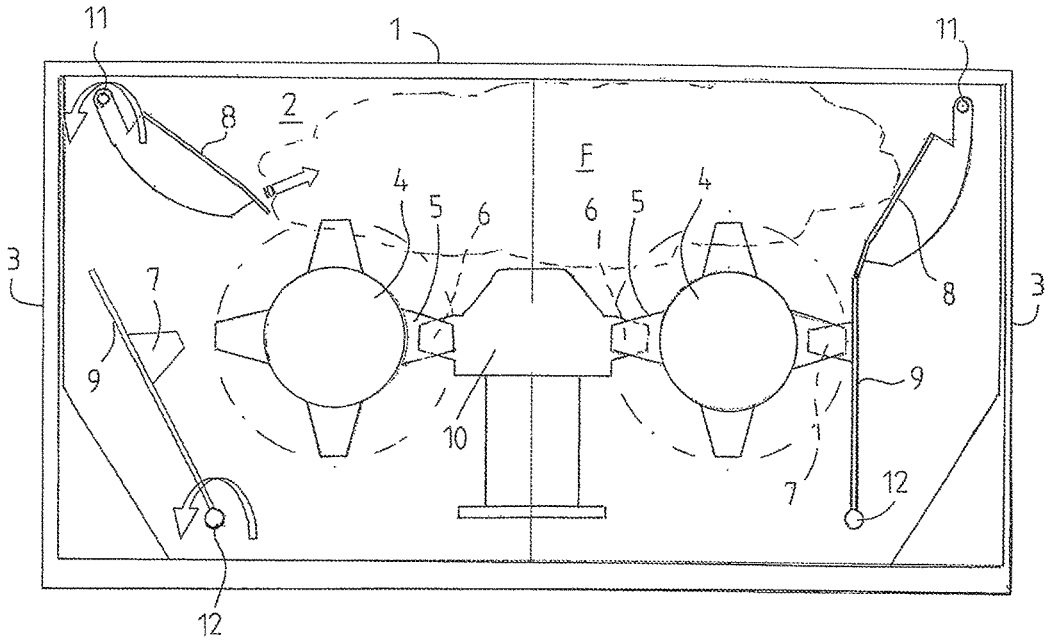

(51) Int. Cl.

| | |
|---|---|
| ***B02C 13/20*** | (2006.01) |
| ***B02C 13/06*** | (2006.01) |
| ***B02C 4/02*** | (2006.01) |
| ***B02C 4/08*** | (2006.01) |
| ***B02C 4/10*** | (2006.01) |
| ***B02C 18/14*** | (2006.01) |
| *B02C 18/16* | (2006.01) |
| *B02C 18/18* | (2006.01) |

(52) U.S. Cl.
CPC ..... *B02C 13/06* (2013.01); *B02C 13/20* (2013.01); *B02C 18/142* (2013.01); *B02C 2018/164* (2013.01); *B02C 2018/188* (2013.01)

(58) Field of Classification Search
USPC ..... 241/243, 73, 242
See application file for complete search history.

(56) References Cited

U.S. PATENT DOCUMENTS 2,705,596 A * 4/1955 Poyser ..... B02C 13/20 241/135
3,343,800 A 9/1967 Rasmussen
3,602,444 A * 8/1971 Meyer ..... B02C 13/095 241/190
3,659,792 A * 5/1972 Von Conrad ..... B02C 13/095 241/21
4,767,066 A * 8/1988 Williams ..... B02C 13/095 241/189.2
4,905,919 A * 3/1990 Okazaki ..... B02C 18/0084 241/160
5,244,158 A * 9/1993 Popovich ..... B02C 13/282 228/135
5,484,110 A * 1/1996 Doppstadt ..... B02C 13/09 241/189.1
5,513,811 A * 5/1996 Phan Hung ..... B02C 13/095 241/189.1
5,562,257 A * 10/1996 Graveman ..... B02C 13/20 241/190
5,697,562 A * 12/1997 Leblond ..... B02C 13/20 241/101.74
6,845,931 B1 1/2005 Smith
7,832,668 B2 * 11/2010 Gassmann ..... B02C 13/20 241/187
2008/0185466 A1 * 8/2008 Howard ..... B02C 13/04 241/187

FOREIGN PATENT DOCUMENTS

EP 1371420 A1 12/2003
WO WO 2012/131162 A1 10/2012

OTHER PUBLICATIONS espacenet English abstract of DE 10 2010 031 685 A1.
Non-English Office Action dated Sep. 29, 2016 for Chinese Application No. 201480029185.7 with English translation.
espacenet English abstract of CN 201711183 U.
espacenet English abstract of CN 102179274 A.

* cited by examiner

CRUSHER

CROSS-REFERENCE TO RELATED APPLICATION

This U.S. application claims priority under 35 U.S.C. 371 to, and is a U.S. National Phase application of, the international Patent Application No. PCT/FI2014/050387, filed 21 May 2014 which claims priority from Finnish Patent Application No. U20134123 flied on 22 May 2013, the disclosures of which are incorporated in their entirety by reference herein.

BACKGROUND OF THE INVENTION

The invention relates to a crusher that comprises a box-like frame with two end walls and two side walls connecting the end walls; at least one crusher rotor that is supported for a rotating movement inside the crusher frame against its end walls; the circumference of the crusher rotor having a plurality of crusher teeth, and the crusher having counter-blade structures arranged to cooperate with the crusher teeth of the crusher rotor, and the material fed into the crusher for crushing being intended to be fed essentially above the centre line of the rotor(s) and to be crushed between the crusher teeth and the counter-blade structures of the crusher rotor. Typically, the present crusher comprises two parallel crusher rotors, even though nothing prevents using a one-rotor crusher.

On the basis of their running speed, crushers may be divided into two categories: fast- and slow-running crushers. Fast-running crushers are efficient, but they require that the material being crushed be free from impurities, because, due to a high circumferential velocity of the crusher rotor, their structures cannot be protected by automatically released safety means. Additional problems include fire hazard and noise and dust problems, among others.

Slow-running crushers are considerably better suited for a wider range of material to be crushed, and they also tolerate impurities. Due to a slow circumferential velocity, their capacities remain low. An increase in the circumferential velocity implies an increased risk of crusher damage, and attempts have been made to prevent this by structures whose counter-blades give way, when foreign objects that are typically of metal are caught between the crusher teeth and the counter-blade structure.

However, the above manner of preventing damage to the crusher leads to expensive solutions and, therefore, in crushers of a lower price category the damage is avoided by limiting the kinetic energy of the crusher rotor to an as low a level as possible and by making the structures strong enough to endure a sudden stop. Generally, crushers have built-in automatics, with which the rotation direction of the crusher rotor is reversed and a new crushing attempt made. There may be several of these repetitions, but finally, when an object not suitable for crushing has ended up among the material being crushed, the crusher stops and raises an alarm. After this, the foreign object is removed manually.

Solutions are known, in which the front wall of the crusher is opened around a joint in the bottom or top part of the wall, and a foreign object can be removed through the opening. In these solutions, the view to the crusher rotors often remains so narrow that it is difficult to remove a foreign object through them and the opening also cannot be utilised during maintenance, such as during the replacement of the crusher rotor.

Structures are also known, in which the entire side wall can be slid upward by means of a chain hoist. In this solution, like in the one mentioned earlier, a big drawback is that, when stopping occurs at a time, when the crusher and the feeding funnel for material to be crushed on top of it are still full of material, the material to be crushed discharges through the opening and causes various problems to the environment.

The following publications, among others, represent the prior art: US 2010252670 A1, EP 2042238 A1, DE 102006050051 A1, US 200686850 A1, U.S. Pat. No. 7,222,805 B1, U.S. Pat. No. 5,743,472 A, GB 2278788 A, U.S. Pat. No. 5,248,100 A, EP 458059 A1, and U.S. Pat. No. 4,385,732 A.

SUMMARY OF THE INVENTION

The object of the invention is to develop the crusher of the type described in the beginning in such a manner that the aforementioned problems will be solved. This object is achieved by a crusher of the invention that is characterised in that two hatches are arranged on at least one side wall side of the crusher, the first hatch being above the centre line of the crusher rotor and pivoted at its top part to the crusher to be turnable toward the centre line of the crusher, and the second hatch being mainly below the centre line of the crusher rotor and movable away from the front of the crusher rotor. Preferred embodiments of the invention are disclosed in the dependent claims.

Thus, in the invention, there are two separate doors or hatches that are hinged to the crusher, for instance, and that may operate independent of each other. The structure prevents extra material from flowing out of the crusher and permits an easier and more hygienic removal of a foreign object. The idea of the invention is that when the upper hatch opens inward, it prevents the crusher rotor and any material still in the feeding funnel from flowing out of the crusher, whereas foreign objects are easily removed through the lower hatch that opens or slides away from the rotor.

LIST OF FIGURES

Figure 2:
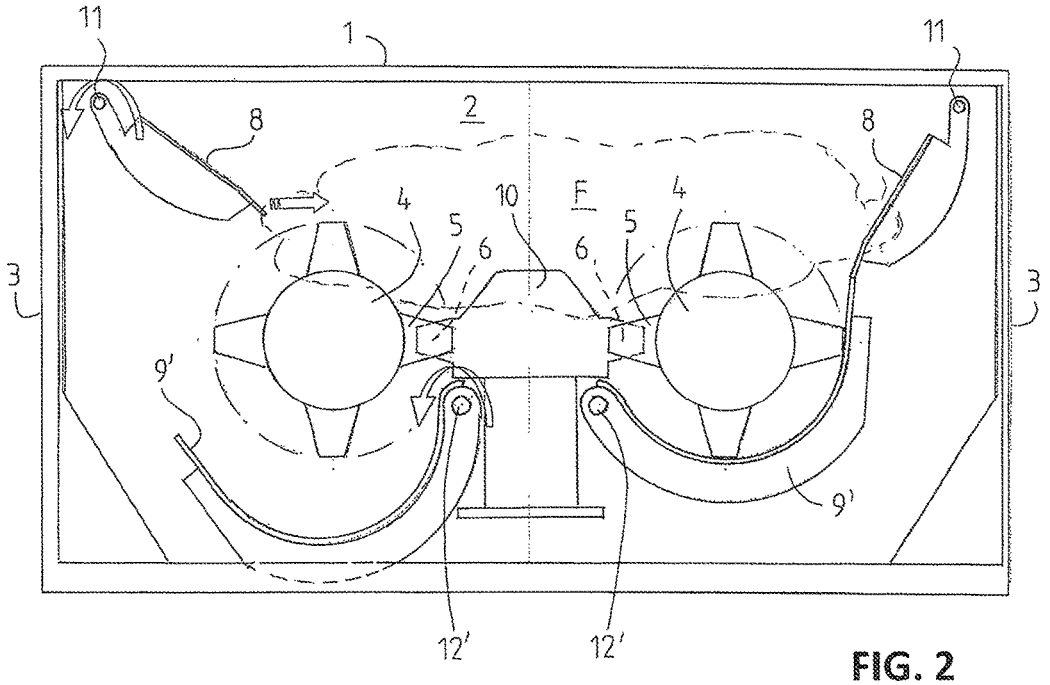
Figure 3:
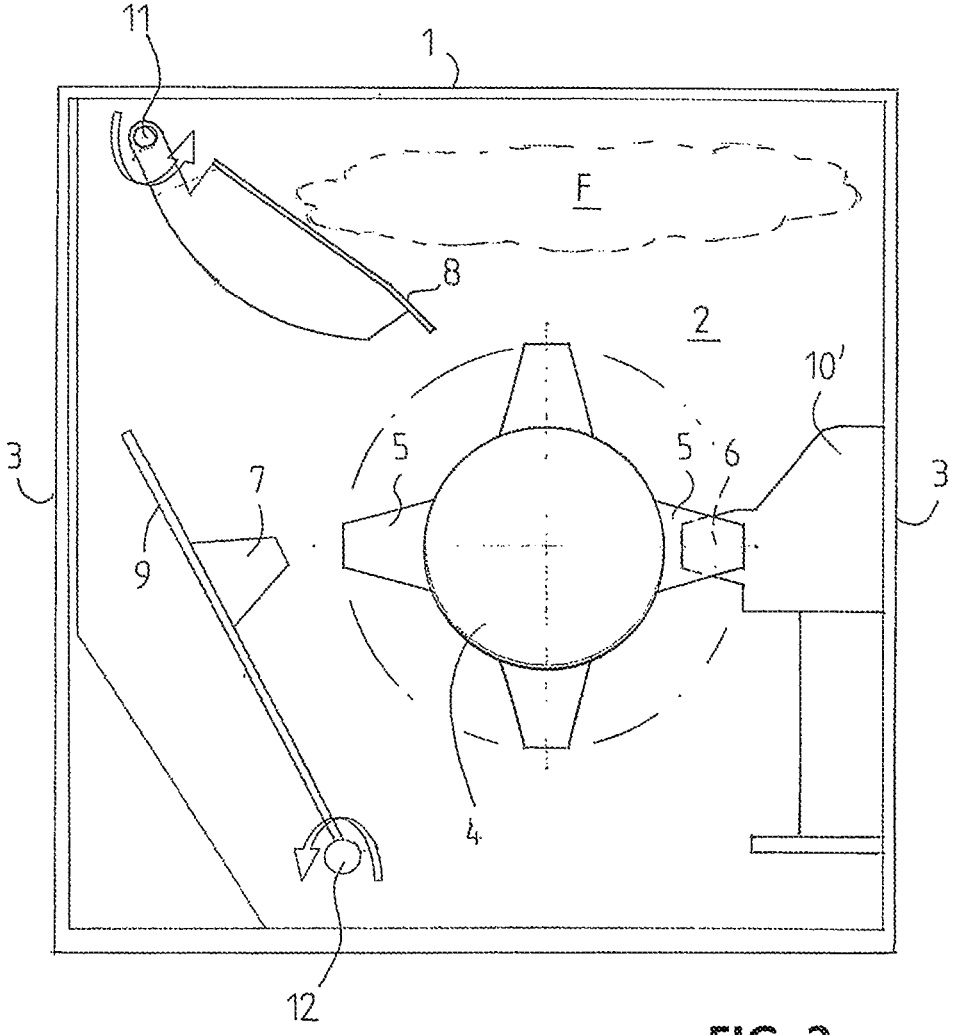

The invention will now be described in more detail in light of three preferred embodiments and with reference to the accompanying drawings, in which FIG. 1 is a simplified cross-sectional view of a crusher of the invention provided with two crusher rotors, FIG. 2 is a simplified cross-sectional view of a second crusher of the invention provided with two crusher rotors, and FIG. 3 is a simplified cross-sectional view of yet another crusher of the invention provided with one crusher rotor.

DETAILED DESCRIPTION OF THE INVENTION

Firstly, FIG. 1 shows by way of example and in a highly simplified manner a crusher of the invention that has a box-like frame 1 with two end walls 2 (of which only the rearmost is visible) and two side walls 3 connecting the end walls 2. Inside the crusher frame 1, on its end walls 2, two parallel crusher rotors 4 are supported, which are driven, i.e. rotated, with conventional actuators that are not shown herein. On the circumference of both crusher rotors 4, there are a plurality of crusher teeth 6, and on the crusher, counter-blade structures 6 and 7 that cooperate with respective crusher teeth 5 of both crusher rotors 4. One counter-blade structure 6 is formed by means of a centre beam 10 in the middle of the crusher, between the crusher rotors 4, the centre beam extending at least to the height of the axles of the crusher rotors 4, and the counter-blade structure 6 is fastened to this centre beam 10. The material F fed into the crusher for crushing is intended to be fed essentially above the centre line of the rotors 4 and to be crushed between the crusher teeth 5 of the crusher rotors 4 and the counter-blade structures 6 and 7 while the crusher rotors 4 are rotated.

The crusher rotor 4 may rotate mainly in one direction only, in which case the crushing of the material F takes place against either of the counter-blade structures 6 or 7. Crushing may also take place as the crusher rotor 4 rotates in either direction, in which case crushing is done against both counter-blade structures 6 and 7.

Two hatches 8 and 9 are arranged on the side of each side wall 3 of the crusher, the first hatch 8 being above the centre line of the crusher rotor 4 and pivoted by joints 11 at its top part to the end walls 2 of the crusher to be turnable toward the centre line of the crusher, and the second hatch 9 being mainly below the centre line of the crusher rotor 4 and pivoted at its bottom part by joints 12 to the end walls 2 of the crusher to be turnable away from the crusher rotor 4. The ends of the first and second hatches 8 and 9 facing each other engage in the closed position. In this exemplary implementation, the lower, second hatch 9 comprises a second counter-blade structure 7.

The structure of FIG. 2 differs from that of FIG. 1 only in that the lower, second hatch 9' is now formed of a sieve below the crusher rotor 4, which is at a selected distance from the crusher teeth 5 of the crusher rotor 4 and extends to a selected sector of the crusher rotor 4, whereby this sieve forming the second hatch 9' is pivoted at one end to the crusher by joints 12' to be turnable away from the crusher rotor 4 on the side wall 3 side of the crusher. This hatch 9' does not contain an actual counter-blade structure, but may also have properties that crush material.

FIG. 3, in turn, shows a crusher that is provided with one crusher rotor 4 and that is essentially one half of the crusher of FIG. 1. The centre beam 10 is then also halved into a "side beam" 10*a*. Correspondingly, the crusher of FIG. 2 can also be made into a halved structure in the same manner.

When a hard object that is typically of metal enters between the crusher rotor 4, its crusher teeth 5 and counter-blade structure 6, 7, the crusher rotor 4 stops and raises an alarm. In cases, where the crushing does not take place against the counter-blades 7 on the top hatch 8, the removal of foreign objects is started by rotating the crusher rotor 4 in the opposite direction, in which case the foreign object comes close to the lower hatch 9, 9' that can be opened. The upper hatch 8 is then turned inward toward the centre of the crusher, in which case the material to be crushed on top of the crusher rotor 4 moves toward the centre of the crusher and is prevented from flowing out. Next, the lower hatch 9, 9' is opened to gain clear access to the crusher rotor 4 and the foreign object can easily be removed.

The above description of the invention is only intended to illustrate the basic idea of the invention. A person skilled in the art may thus vary its details within the scope of the attached claims. Therefore, the lower, second hatch may also be a hatch that can be slid away from the front of the crusher rotor. The hatch structure may also be on only one side of the crusher, or there may be differing hatch structures on the opposite sides of the crusher. The hatch structures may also form part of the side walls.

The invention claimed is:

1. A crusher comprising (a) a crusher frame having two end walls and two side walls connecting the end walls, (b) at least one crusher rotor that is supported on the crusher frame for rotating movement around an axis of rotation, the at least one crusher rotor comprising a plurality of crusher teeth disposed around a circumference thereof;

(c) a plurality of counter-blade structures disposed within the crusher frame; the at least one crusher rotor and the plurality of counter-blade structures being configured and arranged within the crusher such that, with the at least one rotor rotating, material fed into the crusher frame from above the at least one rotor can be crushed between the crusher teeth and the plurality of counter-blade structures;

(d) at least a first upper hatch and a first lower hatch each of which comprises a pivot end and a free end, the pivot end of the upper hatch being pivotally joined to a first of the end walls at a joint that is disposed above the axis of rotation of the at least one crusher rotor and between the at least one crusher rotor and a first of the side walls, the pivot end of the lower hatch being pivotally joined to the first end wall at a joint that is below the axis of rotation of the at least one crusher rotor, the at least first upper and lower hatches being pivotable about their respective pivot ends between a closed configuration, wherein the respective free ends of the upper and lower hatches are adjacent to one another, and an open configuration, wherein the respective free ends of the upper and lower hatches are spaced from one another and form an opening through which an object can be removed, and wherein, with the at least first upper and lower hatches pivoting from the closed configuration to the open configuration, the free end of the first upper hatch moves toward a top of the at least one crusher rotor and prevents material that is disposed atop the at least one crusher rotor from exiting through the opening.

2. The crusher as claimed in claim 1, wherein the crusher comprises, in addition to the at least one crusher rotor, a second crusher rotor that is supported on the crusher frame and that has an axis of rotation that is parallel to the axis of rotation of the at least one crusher rotor.

3. The crusher as claimed in claim 1, wherein with the at least first upper and lower hatches pivoting from the closed configuration to the open configuration, the free end of the first lower hatch moves away from the at least one crusher rotor.

4. The crusher as claimed in claim 3, wherein the first lower hatch comprises at least one of the plurality of counter-blade structures.

5. The crusher as claimed in claim 1, wherein the first lower hatch comprises a sieve and is disposed at a first position below the at least one rotor with the at least first upper and lower hatches in the closed configuration, the free end of the first lower hatch moving away from the at least one crusher rotor when the first upper and lower hatches pivot from the closed configuration to the open configuration.

6. The crusher as claimed in claim 1, wherein the at least first lower hatch slides away from the crusher rotor when the at least first upper and lower hatches pivot from the closed configuration to the open configuration.

7. The crusher as claimed in claim 1, wherein the free ends of the at least first upper and lower hatches engage in the closed position.

8. The crusher as claimed in claim 2, comprising a center beam disposed between the at least one crusher rotor and the second crusher rotor, the center beam extending from below the crusher rotors at least to a height of the axes of the crusher rotors, the center beam comprising at least one of the plurality of counter-blade structures.

9. The crusher as claimed in claim 2, wherein, in addition to the at least first upper hatch and lower hatch, the crusher comprises a second upper hatch and a second lower hatch disposed on an opposite side of the frame from the at least first upper and lower hatches, each of the second upper hatch and the second lower hatch each comprising a pivot end and a free end, the pivot end of the second upper hatch being pivotally joined to the first end wall at a joint that is disposed above the axis of rotation of the second crusher rotor and between the second crusher rotor and a second of the side walls, the pivot end of the second lower hatch being pivotally joined to the first end wall at a joint that is below the axis of rotation of the second crusher rotor, the second upper and lower hatches being pivotable about their respective pivot ends between a closed configuration, wherein the respective free ends of the second upper and lower hatches are adjacent to one another, and an open configuration, wherein the respective free ends of the second upper and lower hatches are spaced from one another and form a second opening through which an object can be removed, and wherein, with the second upper and lower hatches pivoting from the closed configuration to the open configuration, the free end of the second upper hatch moves toward a top of the second crusher rotor and prevents material that is disposed atop the second crusher rotor from exiting through the second opening.

10. The crusher as claimed in claim 9, wherein the at least first upper and lower hatches are different in structure than the second upper and lower hatches.

11. The crusher as claimed in claim 1, wherein the upper and lower hatches form part of the first side wall.

12. A crusher as claimed in claim 2, wherein the second lower hatch pivots away from the second rotor when the second upper and lower hatches pivot from the closed configuration to the open configuration.

13. The crusher as claimed in claim 5, wherein the second lower hatch comprises a sieve and is disposed at a first position below the at least one rotor with the second upper and lower hatches in the closed configuration, the free end of the second lower hatch moving away from the second crusher rotor when the second upper and lower hatches pivot from the closed configuration to the open configuration.

14. The crusher as claimed in claim 2, wherein the second lower hatch slides away from the crusher rotor when the at least first upper and lower hatches pivot from the closed configuration to the open configuration.

* * * * *